United States Patent [19]

Fleming et al.

[11] 4,000,094

[45] Dec. 28, 1976

[54] WATER-INSOLUBLE ALUMINOSILICATE-CONTAINING DETERGENT COMPOSITION

[75] Inventors: Howard P. Fleming; H. Karl Krummel, both of Cincinnati, Ohio

[73] Assignee: The Procter & Gamble Company, Cincinnati, Ohio

[22] Filed: Nov. 8, 1974

[21] Appl. No.: 522,373

[52] U.S. Cl. ..... 252/557; 252/89 R; 252/131; 252/179; 252/383; 252/558

[51] Int. Cl.[2] ..... C11D 3/12; C11D 3/34; C11D 11/00; C11D 17/06

[58] Field of Search ..... 252/89, 131, 538, 557, 252/383

[56] References Cited

UNITED STATES PATENTS

| | | | |
|---|---|---|---|
| 3,325,422 | 6/1967 | Marquis | 252/383 |
| 3,328,314 | 6/1967 | Marquis | 252/383 |
| 3,424,690 | 1/1969 | Marquis | 252/552 X |
| 3,533,944 | 10/1970 | Yuan | 252/383 |
| 3,798,183 | 3/1974 | Bruson | 252/557 |
| 3,801,511 | 4/1974 | Lemoff | 252/135 |
| 3,915,903 | 10/1975 | Wise | 252/552 |

FOREIGN PATENTS OR APPLICATIONS

| | | | |
|---|---|---|---|
| 2,422,655 | 11/1974 | Germany | 252/131 |

*Primary Examiner*—Dennis L. Albrecht
*Attorney, Agent, or Firm*—Robert B. Aylor; Thomas H. O'Flaherty; Charles R. Wilson

[57] ABSTRACT

A process for producing a spray-dried detergent composition containing a water-insoluble aluminosilicate. Sodium carbonate and a water-soluble salt of an organic compound having from 1 to 6 carbon atoms substituted with a sulfate or sulfonate group and at least one carboxyl group are added to an aqueous slurry containing the aluminosilicate and an organic detergent. Granules produced by spray-drying the aqueous slurry are crisp and free-flowing.

9 Claims, No Drawings

WATER-INSOLUBLE ALUMINOSILICATE-CONTAINING DETERGENT COMPOSITION

BACKGROUND OF THE INVENTION

This invention relates to spray-dried detergent compositions and processes for their production. More particularly, it relates to spray-dried detergent compositions containing a water-insoluble aluminosilicate as a detergency builder.

Commonly assigned patent application Ser. No. 450,266 filed Mar. 11, 1974, "Detergent Composition" by John Michael Corkill, Bryan L. Madison and Michael E. Burns discloses the use of certain aluminosilicates as detergency builders. Builders, e.g. sodium tripolyphosphates, are used in detergent compositions for the purpose of tying-up hardness ions normally found in water. In the absence of the tying-up of the hardness ions, the maximum detergency obtainable from the detergent composition is not realized. That is, the hardness ions, normally calcium and magnesium ions, react with the soil and/or the detergent to hinder the cleaning action of the detergent composition. While sodium tripolyphosphate is an excellent builder, there is a concern about its effect on the ecology.

As discussed in the aforementioned copending patent application, a restricted number of aluminosilicates have been found to have utility as builders in detergent compositions. Water-insoluble aluminosilicates of formula $$Na_z[(AlO_2)_z \cdot (SiO_2)_y]xH_2O$$

wherein $z$ an $y$ are at least 6, the molar ration of $z$ to $y$ is from 1.0 to 0.5 and $x$ is from 15 to 264, have been found to be satisfactory for such a use. Conventionally, granular detergent compositions are produced by slurrying all or most of the composition's components and then spray-drying the slurry. Unfortunately, the spray-drying of an aqueous slurry containing the aforementioned aluminosilicate and an organic detergent results in granules which are not crisp and freeflowing. Such attributes are desirable so as to permit the user of the detergent compositon to conveniently pour it from a package and properly measure it prior to its addition to a washing machine. The problem is especially acute in those areas where a combination of high temperature and high humidity causes the detergent composition granules to cake while in the package. While the performance of such a product is not materially affected, the negative effect it has on the consumer is significant.

Various solutions to the problem of caking detergent compositions have been suggested. More moisture-resistant packages is one solution which has been used. Unfortunately, such packages are more expensive. Generally, the addition of components having a known anti-caking effect, for example, sodium silicate, have been used. It is believed that the sodium silicate, together with the aluminosilicate, results in relatively large insoluble particles during the spray-drying operation which, when added to the washing solution, deposit upon the fabrics. Such a deposition is readily noticeable by the consumer.

U.S. Pat. No. 3,328,314 issued June 27, 1967 to Marquis and U.S. Pat. No. 3,424,690 issued Jan. 28, 1969 to Marquis disclosed the use of sodium and potassium sulfosuccinate in detergent compositions containing linear alkyl benzene sulfonate and secondary alkyl sulfates and sulfontes respectively, for an anti-caking effect. However, the use of such compounds in combination with water-insoluble aluminosilicate builders is not suggested. Moreover, it has been found that the addition of the sulfosucinate to an aqueous slurry containing the water-insoluble aluminosilicates has an insufficient effect on the crispness and free-flowability of resultant spray-dried granules having a desirable density.

It has now been descovered that the addition of sodium carbonate and an organic compound having from 1 to 6 carbon atoms substituted with a sulfate or sulfonate group and at least one carboxyl group, when added to an aqueous slurry containing a water-insoluble aluminosilicate and an organic detergent, results in granules produced therefrom by spray-drying which are crisp and free-flowing. Moreover, the granules remain crisp and free-flowing even after extended storage under conditions of high temperature and relative humidity, e.g. 90° F. and 80% relative humidity.

It is accordingly an object of this invention to produce by spray-drying an aluminosilicate-containing detergent composition which is crisp and free-flowing.

Another object of this invention is to produce by spray-drying an aluminosilicate-containing detergent composition which remains crisp and free-flowing after extended storage.

It is still another object of this invention to produce a spary-dried aluminosilicate-containing detergent composition which is crisp and free-flowing by an economical and efficient process.

As used herein, all percentages and ratios are by weight unless otherwise indicated. The weight percent of the aluminosilicate builder is expressed on an anhydrous basis.

SUMMARY

A process for producing crisp free-flowing built detergent composition granules and the product so produced by spray-drying an aqueous slurry having therein included processing aids comprising the steps of (a) forming an aqueous slurry consisting essentially of (1) from 25% to 75% on a dry weight basis of a water-insoluble aluminosilicate builder having the formula $$Na_z[(AlO_2)_z \cdot (SiO_2)_y]xH_2O$$

wherein $z$ and $y$ are at least 6, the molar ration of $z$ to $y$ is from 1.0 to about 0.5 and $x$ is from 10 to 264; (2) from 5% to 25% on a dry weight basis of an organic detergent selected from the group consisting of anionic, nonionic, zwitterionic, and ampholytic detergents, and mixtures thereof; (3) as processing aids from 2% to 20% on a dry weight basis of a mixture of sodium carbonate and a water-soluble salt of an organic compound having from 1 to 6 carbon atoms substituted with a sulfate or sulfonate group and at least one carboxyl group wherein the ratio of sodium carbonate to organic compound is from 10:1 to 1:10; and (4) the balance water; and (b) spray-drying the slurry to form the crisp free-flowing granules.

DETAILED DESCRIPTION OF THE INVENTION

A spray-dried detergent composition containing a water-insoluble aluminosilicate as a builder is produced by an efficient process. The resultant granules are crisp and free-flowing as produced and remain so even after extended storage under conditions of high temperature and humidity.

Spray-drying of aqueous slurries to obtain built detergent composition granules is a well known drying process. An aqueous slurry having a temperature of from 105° to 250° F of all or a part of the detergent composition is formed and atomized into the top of a spray-drying tower. In one method of spray-drying, a source of hot air, i.e., air having a temperature ranging from 300° to 800° F is introduced at the base of the tower. As the hot air rises, it contacts the falling atomized droplets, thereby driving off substantially all the water. The resultant granules are collected at the base of the tower, while the water-laden air exits at the top. In another method of spray-drying, a source of hot air is introduced along with the atomized droplets at the same end of the tower. Such known spray-drying processes all enjoy the benefits of the present invention as hereindescribed.

Processing aids used in the aqueous slurry of this invention are a mixture of sodium carbonate and a water-soluble salt of an organic compound having from 1 – 6 carbon atoms (exclusive of substituent groups) substituted with a sulfate or a sulfonate group and at least one carboxyl group. The substituted organic compound may be cyclic, acylic or aromatic. The alkaline metals, e.g., sodium, are the preferred water-solubilizing cations with both the alkyl and aryl processing aids. The organic processing aids may be fully neutralized or partially neutralized depending on the end use of the final detergent composition and its desired pH. Generally, the organic processing aids of this invention are fully neutralized.

Examples of suitable organic processing aids are the water-soluble salts of sulfosuccinic acid, sulfoacetic acid, sulfophthalic acid and m-sulfobenzoic acid. Preferred organic processing aids are the watersoluble salts of an alkane having from 1 –4 carbon atoms, substituted with a sulfate or sulfonate group, and with from 1 to 2 carboxyl groups. An especially preferred processing aid is the trisodium salt of sulfosuccinic acid. A preferred aromatic processing aid is a water-soluble salt of m-sulfobenzoic acid.

The ratio of sodium carbonate to the water-soluble organic compound is from 10:1 to 1:10, preferably 2:1 to 1:2. The mixture is included in the aqueous slurry at a level of from 2% to 20%, preferably 5% to 15% on a dry weight basis. An addition of the mixture at a level below 2% to the aqueous slurry has no noticeable effect on the crispness of the spray-dried products. A level above 20% of the mixture in the aqueous slurry has no noticeable additional effect on the crispness of the resultant spray-dried product. Additionally, it has been found that the sodium carbonate and the water-soluble organic compound must be used in order to get the desired crispness of the spray-dried product. The absence of either compound in the slurry results in unsatisfactory spray-dried granules.

An additional benefit obtained from the inclusion of the above-described processing aid mixture in the aqueous slurry is that the resultant spray-dried granules have a density of from 0.20 grams/cc. to 0.40 grams/cc. The density of the spray-dried granules is important in that it allows for proper packing and labeling and measuring by the consumer. The inclusion of both the sodium carbonate and organic component in the aqueous slurry provides a beneficial influence on the density of granules when the slurry is spray-dried.

Another component of the aqueous slurry is a water-insoluble aluminosilicate. The aluminosilicates which have been found to have utility in a detergent composition as a detergency builder have the formula $$Na_z[(AlO_2)_z \cdot (SiO_2)_y]x\ H_2O$$

wherein $z$ and $y$ are at least 6, the molar ratio of $z$ to $y$ is from 1.0 to 0.5 and $x$ is from 10 to 264. These compounds are commercially available. The particle size of the insoluble aluminosilicate is from 0.1 micron to 100 microns, preferably from 0.2 micron to 10 microns. A preferred water-insoluble aluminosilicate has the formula $$Na_{12}\ (AlO_2 \cdot SiO_2)_{12} \cdot x\ H_2O$$

where $x$ is from 15 to 30, preferably 27.

Additionally, the aluminosilicate is in a hydrated form, i.e. contains from 10% to 28%, preferably 18% to 22% water. The aluminosilicate is included in the aqueous slurry at a level of from 25% to 75%, preferably 40% to 60% on a dry weight basis.

Also included in the aqueous slurry, is an organic detergent. The organic detergent is selected from the group consisting of anionic, nonionic, zwitterionic and ampholytic detergents and mixtures thereof. U.S. Pat. No. 3,579,454 issued to Everett J. Collier, May 18, 1971 (the disclosure of which is herein incorporated by reference) contains a disclosure of organic detergents which are exemplary of detergents useful in the present invention. Other organic detergents may be used. From 5% to 25%, preferably 15% to 22% on a dry weight basis of the slurry is represented by the organic detergent.

The balance of the slurry comprises water. The amount of water contained in the aqueous slurry is based on the amount needed to produce a slurry having a viscosity that is low enough to facilitate pumping and atomizing. As small an amount of water as possible is used because of the necessity of later removing it along with the consequent drying expenses. Yet, enough water must be used so as to obtain a slurry that can be pumped and atomized. Generally, from 20% to 40% water is in the slurry.

Commonly used detergent components may also be included in the slurry. For example, from 1% – 40% on a dry weight basis of sodium sulfate may be added to the slurry. Other detergent composition components, for example, soil suspenders, enzymes, coloring matter and perfumes may be added to the aqueous slurry prior to spray-drying or simply admixed with the spray-dried granules.

The above-described aqueous slurry is next efficiently spray-dried by known procedures to produce spray-dried detergent granules which are crisp and freeflowing.

The spray-dried granules of this invention are substantially dry, i.e., contain less than 15% water. The granules consist essentially of a. from 25% to 75%, preferably 40% to 60% of the above-described water-insoluble aluminosilicate;

b. from 5% to 25%, preferably 15% to 22%, of the above-described organic detergent;

c. from 2% to 20%, preferbly 5% to 15%, of a mixture of sodium of carbonate and the above-described water-soluble salt of an organic compounds, in a weight ratio of sodium carbonate to organic compound of from 10:1 to 1:10; preferably 2:1 to 1:2.

The following examples are illustrative of the invention

EXAMPLE I

Aqueous slurries containing the following components on a dry weight basis are prepared:

| | A | B | C | D |
|---|---|---|---|---|
| Aluminosilicate $Na_{12}(AlO_2 \cdot SiO_2)_{12} \cdot 27\ H_2O$ | 54.0% | 54.0% | 54.0% | 54.0% |
| Sodium salt of linear $C_{12}$ alkylbenzene sulfonate | 7.5 | 7.5 | 7.5 | 7.5 |
| Sodium salt of $C_{16.6}$alkylsulfate | 6.0 | 6.0 | 6.0 | 6.0 |
| Sodium salt of $C_{14.6}$alkyl ethoxy sulfate containing an average of 2.25 moles ethylene oxide | 6.0 | 6.0 | 6.0 | 6.0 |
| Sodium carbonate | 7.5 | — | 7.5 | — |
| Trisodium sulfosuccinate | 4.3 | 4.3 | — | — |
| Sodium sulfate | 12.7 | 20.2 | 17.0 | 24.5 |
| Miscellaneous (brighteners, etc.) | 2 | 2 | 2 | 2 |

The slurries each contain 48% water. The ratio of sodium carbonate to trisodium sulfosuccinate in the slurry is 1.75:1.

Each of the above slurries is dried under essentially the same conditions. That is, each was pumped to the top of a spray-drying tower and atomized through a spray nozzle. Hot air is introduced at the bottom of the tower and exits at the top. The dried granules contain 8% water. The densities of Compositions A, B, C, and D are 0.34, 0.26, 0.31, and 0.22 grams/cc, respectively.

The resultant granules, collected at the bottom of the tower, are packed in standard detergent composition packages and then stored at 90° F and 80 % relative humidity. At various time intervals, the contents of the packages are poured out to determine the crispness and free-flowability of the detergent composition. Grades ranging from 0 to 5 are assigned to each of the compositions. A value grade of 5 represents the most free-flowing composition. A value grade of 0 represents a composition which has completely caked and will not pour from the package. The following results are obtained:

| | Time (Days) | | | |
|---|---|---|---|---|
| | 3 | 7 | 10 | 14 |
| Composition A | 4.4 | 4.8 | 4.4 | 3.9 |
| Composition B | 5.0 | 4.2 | 3.0 | 3.0 |
| Composition C | 3.8 | 3.9 | 2.4 | 2.3 |
| Composition D | 3.2 | 2.2 | 2.2 | 2.4 |

The above results show that the composition of this invention (A) possess better crispness and flowability both initially and after prolonged storage than those compositions wherein only sodium sulfosuccinate (B), only sodium carbonate (C), or neither sodium sulfosuccinate nor sodium carbonate (D) is used.

Substantially the same results are obtained when sodium and potassium sulfoacetate, sulfophthalate and m-sulfobenzoate and potassium sulfosuccinate are substituted for the sodium sulfosuccinate of slurry A at the same level.

When Example I is repeated, using (1) 1% sodium carbonate and 1% trisodium sulfosuccinate, (2) 3% sodium carbonate, and 10% trisodium sulfosuccinate, (3) 10% sodium carbonate and 6% sodium m-sulfobenzoate, (4) 15% sodium carbonate and 5% potassium sulfoacetate, and (5) 5% sodium carbonate and 3% disodium sulfophthalate with the necessary adjustment in sodium sulfate content of slurry A, satisfactory spray-dried granules are obtained.

We claim:

1. A process for producing crisp free-flowing built detergent composition granules by spray-drying an aqueous slurry having therein included processing aids comprising the steps of a. forming an aqueous slurry consisting essentially of 1. from 25% to 75% on a dry weight basis of a water-insoluble aluminosilicate builder having the formula $$Na_z[(AlO_2)_z \cdot (SiO_2)_y] \cdot x\ H_2O$$

wherein $z$ and $y$ are at least 6, the molar ratio of $z$ to $y$ is from 1.0 to 0.5 and $x$ is from 10 to 264;

2. from 5% to 25% on a dry weight basis of an organic detergent selected from the group consisting of anionic, nonionic, zwitterionic, and ampholytic detergents, and mixtures thereof;

3. as processing aids from 2% to 20% on a dry weight basis of a mixture of sodium carbonate and sodium sulfosuccinate wherein the ration of sodium carbonate to sodium sulfosuccinate is about 1.75:1; and 4. the balance water; and b. spray-drying the slurry to form the crisp free-flowing granules.

2. The process of claim 1 wherein the aluminosilicate added to the aqueous slurry has a particle size diameter of from 0.1 micron to 100 microns.

3. The process of claim 2 wherein the aluminosilicate is $$Na_{12}(AlO_2 \cdot SiO_2)_{12} \cdot x\ H_2O$$

wherein $x$ is from 15 to 30.

4. The process of claim 3 wherein the aluminosilicate is $$Na_{12}(AlO_2 \cdot SiO_2)_{12} \cdot 27\ H_2O.$$

5. The process of claim 4 wherein the aluminosilicate represents from 40% to 60% on a dry weight basis of the aqueous slurry.

6. A spray-dried built detergent composition comprised of granules which are crisp and free-flowing and possess excellent storage stability consisting essentially of:

a. from 25% to 75% of a water-insoluble aluminosilicate builder having the formula $$Na_z[(AlO_2)_z \cdot (SiO_2)_y] \cdot x\ H_2O$$

wherein $z$ and $y$ are at least 6, the molar ratio of $z$ to $y$ is from 1.0 to 0.5 and $x$ is from 10 to 264;

b. from 5% to 25% of an organic detergent selected from the group consisting of anionic, nonionic, zwitterionic, and ampholytic detergents and mixtures thereof; and c. as a processing aid from 2% to 20% of a mixture of sodium carbonate and sodium sulfosuccinate in a ratio of sodium carbonate to sodium sulfosuccinate of about 1.75:1.

7. The detergent composition of claim 6 wherein the processing aid represents from 5 to 15% of the composition.

8. The detergent composition of claim 7 wherein the aluminosilicate is $$Na_{12}(AlO_2 \cdot SiO_2)_{12} \cdot x\ H_2O$$

where $x$ is from 15 to 30.

9. The detergent composition of claim 8 wherein the aluminosilicate has a particle size diameter of from 0.1 micron to 100 microns.

* * * * *